US008295748B2

(12) United States Patent
Okamoto

(10) Patent No.: US 8,295,748 B2
(45) Date of Patent: Oct. 23, 2012

(54) BELT CONVEYING APPARATUS AND IMAGE FORMING APPARATUS

(75) Inventor: Osamu Okamoto, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 291 days.

(21) Appl. No.: 12/836,709

(22) Filed: Jul. 15, 2010

(65) Prior Publication Data

US 2011/0026983 A1 Feb. 3, 2011

(30) Foreign Application Priority Data

Jul. 31, 2009 (JP) ..... 2009-179962

(51) Int. Cl.
*G03G 15/01* (2006.01)

(52) U.S. Cl. ..... 399/302; 399/303; 399/308

(58) Field of Classification Search ..... 399/159, 399/162–165, 297, 302, 303, 308, 312, 313; 271/198

See application file for complete search history.

(56) References Cited

U.S. PATENT DOCUMENTS

| | | | | |
|---|---|---|---|---|
| 7,308,215 | B2 * | 12/2007 | Watanabe | 399/67 |
| 7,343,127 | B2 * | 3/2008 | Yamada et al. | 399/301 |
| 7,463,857 | B2 * | 12/2008 | Baba et al. | 399/323 |

FOREIGN PATENT DOCUMENTS

| | | | |
|---|---|---|---|
| JP | 7-97089 | A | 4/1995 |
| JP | 3-123316 | A | 1/2001 |
| JP | 2002-287542 | A | 10/2002 |
| JP | 2004-341346 | A | 12/2004 |

* cited by examiner

*Primary Examiner* — Hoan Tran
(74) *Attorney, Agent, or Firm* — Fitzpatrick, Cella, Harper & Scinto

(57) ABSTRACT

A typical belt conveying apparatus and a typical image forming apparatus according to the present invention includes: an endless belt; a supporting member that rotatably supports the belt; a sensor that detects a predetermined breakage at one end of the belt in a belt width direction; and a detecting mechanism that detects a predetermined breakage at the other end of the belt in the belt width direction by the use of the sensor.

6 Claims, 10 Drawing Sheets

BELT CONVEYING APPARATUS AND IMAGE FORMING APPARATUS

BACKGROUND OF THE INVENTION

1. Field of the Invention

The present invention relates to a belt conveying apparatus for use in an image forming apparatus such as an electrophotographic copying machine and an image forming apparatus.

2. Description of the Related Art

A fixing device of a belt fixing system (i.e., an endless belt conveying apparatus or an image heating device) has been conventionally used in an image forming apparatus (Japanese Patent Application Laid-Open No. 2004-341346). In a fixing device of a belt nip system using a so-called endless belt for a fixing belt or a pressurizing belt, there has arisen a problem of a fatigue breakage due to repeated bending of a belt or a breakage of a belt due to the abutment of a belt end against a deviation preventing/restricting member for a belt. Moreover, there has also arisen a problem of speedy detection of a brakeage with certainty so as to stop an apparatus when a belt is broken.

In view of the above, a configuration, described below, has been proposed in order to speedily detect the breakage of a belt so as to properly take measures to the breakage (Japanese Patent Application Laid-Open No. 2002-287542). That is to say, there has been proposed a method for marking a belt so as to detect a breakage according to a change in marking cycle by a sensor. Alternatively, there has been proposed a method for allowing a contact piece to abut against a belt, and further, detecting non-abutment of the contact piece by a sensor, so as to detect a breakage on the belt.

However, in the belt conveying apparatus or the image heating device, the belt is liable to be broken at the end thereof caused by the configuration of the apparatus, a belt fabricating method, or the like. As a consequence, in the case where the sensor or the contact piece for detecting the breakage of the belt is disposed, as disclosed in Japanese Patent. Application Laid-Open No. 2002-287542, it is necessary to dispose the sensors or the contact pieces at both ends of the belt, thereby inducing complication and cost-up.

SUMMARY OF THE INVENTION

The present invention provides a belt conveying apparatus and an image forming apparatus capable of detecting a breakage on a belt.

The present invention also provides a belt conveying apparatus including: an endless belt; a supporting member that rotatably supports the belt; a first abutment member that abuts against one end of the belt in a belt width direction; a first biasing member that urges the first abutment member against the other end of the belt in the belt width direction; a sensor that detects the position of the first abutment member in the belt width direction; a deviation mechanism that deviates the supporting member in response to an output from the sensor; a second abutment member that abuts against the other end of the belt in the belt width direction; and a second biasing member that urges the second abutment member toward one end of the belt in the belt width direction in such a manner that the first abutment member is moved against the first biasing member by the second abutment member according to a predetermined breakage at the other end of the belt in the width direction.

Further features of the present invention will become apparent from the following description of exemplary embodiments with reference to the attached drawings.

DESCRIPTION OF THE EMBODIMENTS

[First Embodiment]

A belt conveying apparatus and an image forming apparatus in a first embodiment according to the present invention are described below with reference to the attached drawings.

(Image Forming Apparatus)

Figure 3:
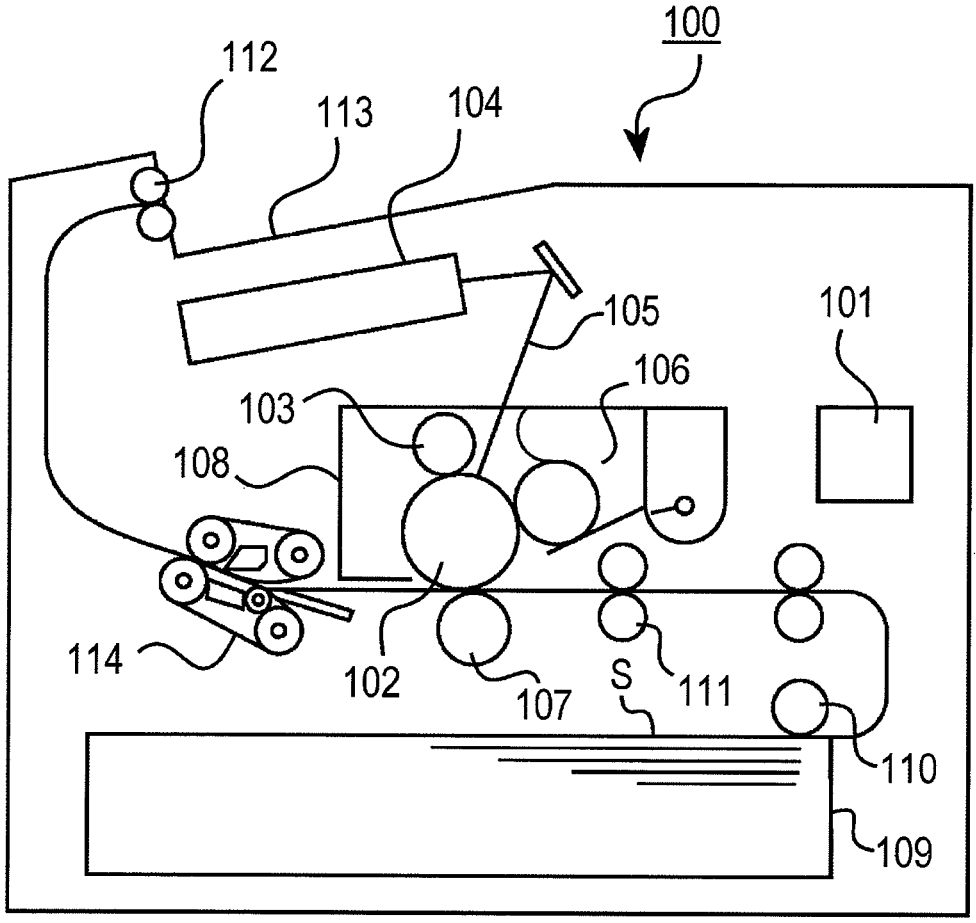
FIG. 3 is a view illustrating an image forming apparatus in the first embodiment.

First, a description will be given of the entire configuration of an image forming apparatus. As illustrated in FIG. 3, an image forming apparatus 100 adopting an electrophotographic system in the embodiment includes an image forming unit which forms a toner image on a sheet (i.e., a recording material) S and a fixing device (i.e., an image heating device) 114 serving as an image heating device.

The image forming unit includes a photosensitive drum (i.e., an image bearing member) 102, a charging portion (i.e., a charging unit) 103, an exposing device (i.e., an exposing unit) 104, and a development device (i.e., a developing unit) 106. The photosensitive drum 102 is uniformly charged at the surface thereof by the charging portion 103, to be irradiated with a light beam 105 from the exposing device 104 according to an image, and thus, an electrostatic latent image is formed. The electrostatic latent image is developed by the development device 106, and thus, a toner image is formed.

On the other hand, the sheets S are stacked in a sheet cassette 109 in the lower portion of the apparatus, and they are fed by a feeding roller 110. The fed sheet S is conveyed by a pair of registration rollers (i.e., conveying units) 111 in synchronism with the toner image formed on the photosensitive drum 102. The toner image formed on the photosensitive drum is electrostatically transferred onto the conveyed sheet S by a transfer roller (i.e., a transfer member) 107, to be then conveyed to the fixing device 114. The sheet S conveyed to the fixing device 114 is heated and pressurized thereat, and then, the electrostatically transferred toner image is fixed onto the sheet S. The sheet S having the toner image fixed thereonto is conveyed and discharged to a discharge tray 113 in the upper portion of the apparatus by a pair of discharge rollers 112. The toner remaining on the photosensitive drum 102 is removed by a cleaning device (i.e., a cleaning unit) 108.

(Fixing Device 114)

Next, the fixing device 114 will be described with reference to FIGS. 1, 2, and 4 to 6.

Figure 1A:
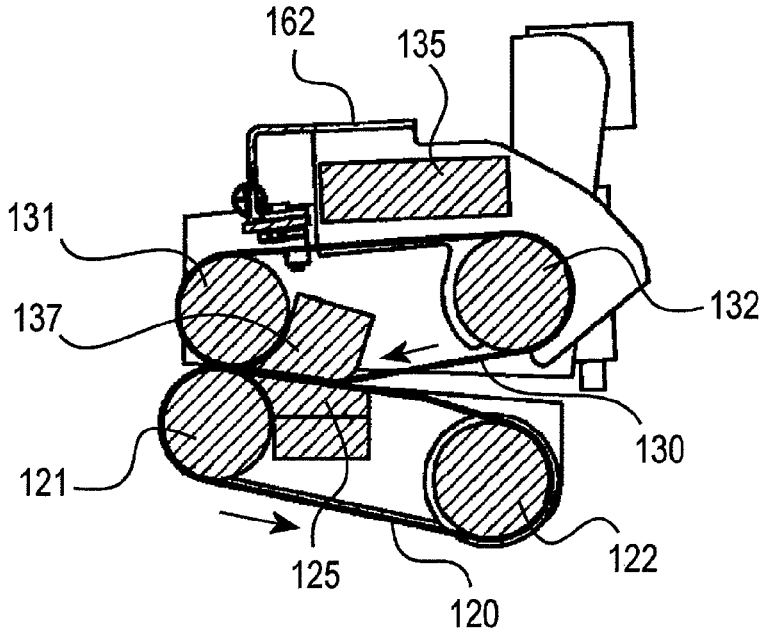
FIG. 1A is a cross-sectional view illustrating an image heating device in a first embodiment.

FIG. 1A is a view illustrating the configuration of the fixing device 114. As illustrated in FIG. 1A, the fixing device 114 includes a pressurizing belt (i.e., an endless belt) 120, a pressurizing roll (i.e., a support member) 121, a tension roll (i.e., another support member) 122, and a pressurizing pad 125. Furthermore, the fixing device 114 includes a heating belt (another endless belt) 130, a drive roll (i.e., a further support member) 131, a steering roll (i.e., a still further support member and a belt steering unit) 132, and a pad stay 137.

The pressurizing belt 120 is circulatably and rotatably stretched across the two support rolls (i.e., the pressurizing roll 121 and the tension roll 122) under a predetermined tension (200 N). In the meantime, the heating belt 130 is circulatably and rotatably stretched across the other two support rolls (i.e., the drive roll 131 and the steering roll 132) under a predetermined tension (e.g., 200 N).

The pressurizing belt 120 is obtained by coating a nickel metal layer having a thickness of 50 μm, a width of 380 mm, and a circumferential length of 200 mm with a silicon rubber having a thickness of 300 μm, and then, covering the surface with a PFA tube. The pressurizing belt 120 may be appropriately selected from any belt as long as it has heat resistance.

The heating belt 130 is obtained by coating a magnetic metal layer such as a nickel metal layer or a stainless steel layer having a thickness of 75 μm, a width of 380 mm, and a circumferential length of 200 mm with a silicon rubber having a thickness of 300 μm, and then, covering the surface with a PFA tube. The heating belt 130 may be appropriately selected from any belt as long as it generates heat by an inductive heating coil 135, and further, has heat resistance.

Figure 1B:
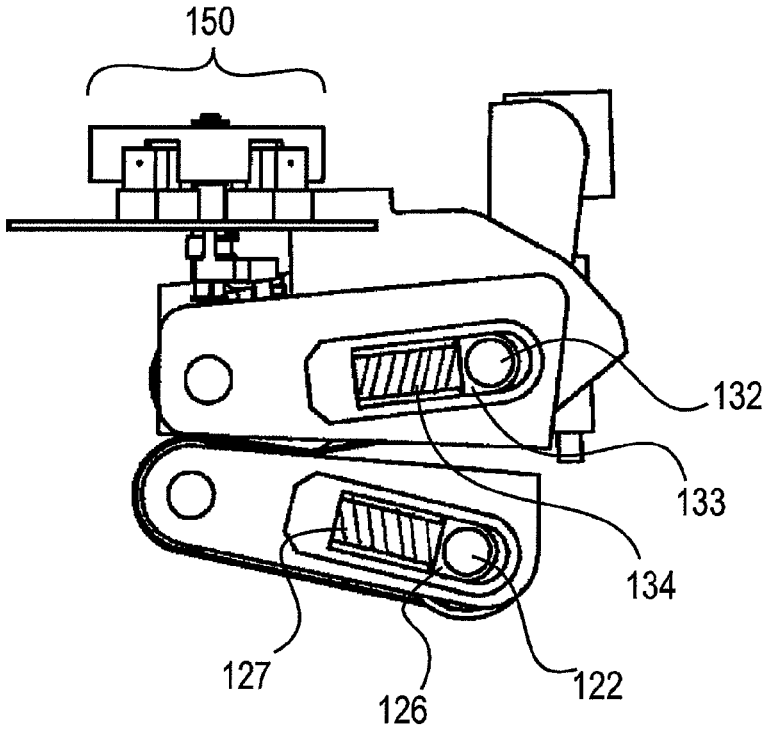
FIG. 1B is a front view illustrating the image heating device in the first embodiment.

The pressurizing roll 121 is made of solid stainless steel in an outer diameter of ϕ20. As illustrated in FIG. 1B, both ends of the tension roll 122 are supported rotatably by bearings 126 and slidably in a belt tension direction, and a tension spring 127 applies a tension of 2N (i.e., 20 kgf) to the pressurizing belt 120. As illustrated in FIG. 1A, the tension roll 122 is a hollow roll made of stainless steel in an outer diameter of about ϕ20 and an inner diameter of about ϕ18.

The drive roll 131 is driven by an outside motor, not illustrated, to be then rotated, thus rotating the heating belt 130. The drive roll 131 is made of solid stainless steel in an outer diameter of ϕ18. A heat resistant silicon rubber elastic layer is molded integrally with the surface of a core metal. The elastic layer of the drive roll 131 is elastically deformed by predetermined amount in press-contact with the pressurizing roll 121.

The steering roll 132 is adapted to adjust meandering of the heating belt 130 in a belt width direction perpendicular to a movement direction (i.e., a rotational direction). As illustrated in FIG. 1B, both ends of the steering roll 132 are supported rotatably by bearings 133 and slidably in a belt tension direction, and a tension spring 134 applies a tension of 2N (i.e., 20 kgf) to the heating belt 130. As illustrated in FIG. 1A, the steering roll 132 is a hollow roll made of stainless steel in an outer diameter of about ϕ20 and an inner diameter of about ϕ18.

The pressurizing pad 125 is disposed inward of the pressurizing belt 120 and on an inlet side of a nip between the pressurizing belt 120 and the heating belt 130 (i.e., upstream of the pressuring roll 121). The pressurizing pad 125 is made of a silicon rubber. On the other hand, the pad stay 137 is disposed inward of the heating belt 130 and on the inlet side of the nip between the heating belt 130 and the pressurizing belt 120 (i.e., upstream of the drive roll 131). The pad stay 137 is made of stainless steel (i.e., an SUS material). The pressurizing pad 125 and the pad stay 137 are urged under a predetermined pressure (400 N) via the pressurizing belt 120 and the heating belt 130, thereby defining a nip in cooperation with the pressurizing roll 121 and the drive roll 131.

(Deviation Control of Heating Belt 130)

Figure 2A:
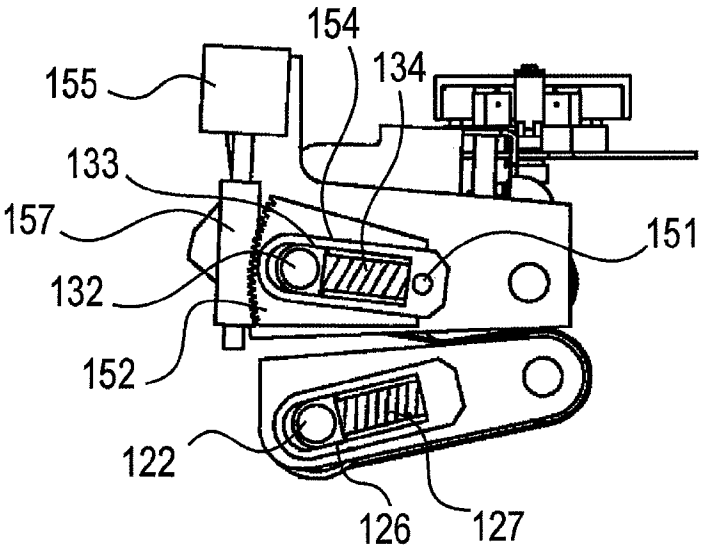
FIG. 2A is a rear view illustrating the image heating device in the first embodiment.

As illustrated in FIG. 2A, a steering roll supporting arm 154 is disposed outside of a side plate. The supporting arm 154 is supported at one end thereof turnably on a shaft 151. At the other end of the supporting arm 154 is provided a displacement mechanism (i.e., a sectoral gear 152, a stepping motor 155, and a worm gear 157) which displaces the support member based on an output from a sensor. The sectoral gear 152 is fixed to the other end of the supporting arm 154. Furthermore, the sectoral gear 152 meshes with the worm gear 157. The worm gear 157 is driven by the stepping motor 155, to be thus rotated.

Figure 2B:
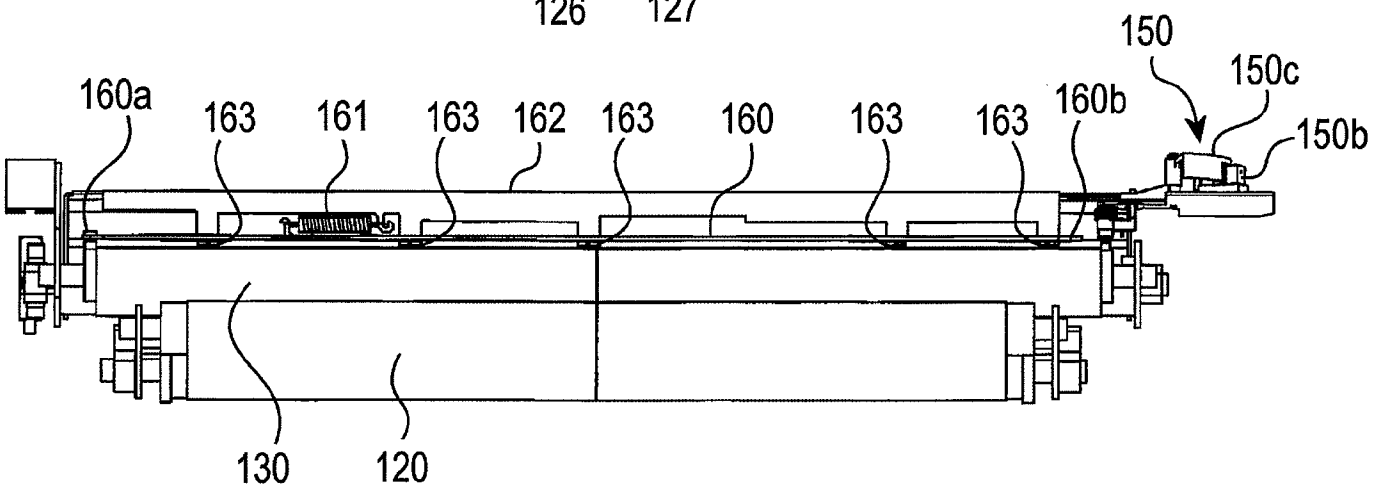
FIG. 2B is a left side view illustrating the image heating device in the first embodiment.

As illustrated in FIG. 2B, the fixing device 114 is provided with a sensor 150 at one end in a belt width direction. The sensor 150 detects the position of the end of the heating belt 130, and accordingly, the stepping motor 155 is rotated by predetermined rotational times, to turn the support arm 154 via the worm gear 157 and the sectoral gear 152, thereby changing the inclination of the steering roll 132. As a consequence, the deviation of the heating belt 130 is controlled.

Figure 4A:
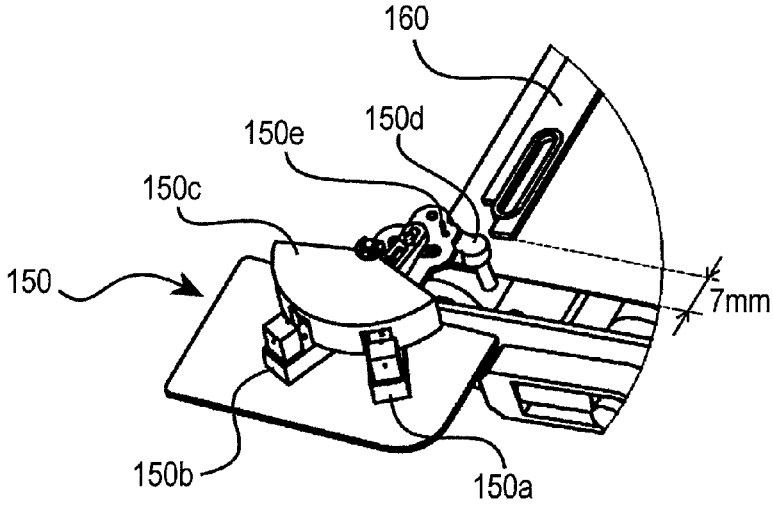
FIG. 4A is a perspective view illustrating the image heating device in the first embodiment, as viewed from the top-right front.
Figure 4B:
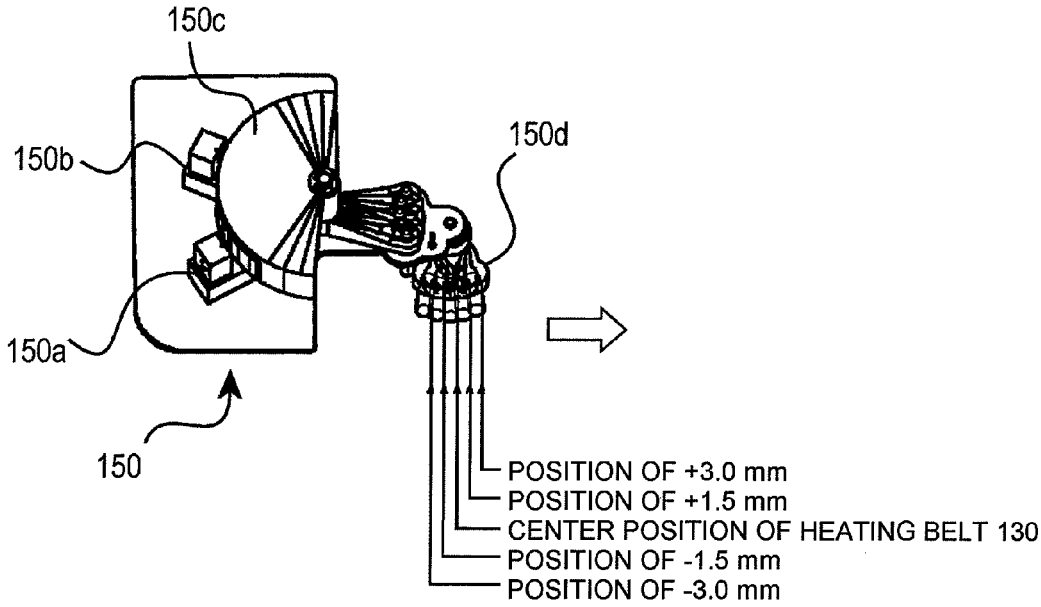
FIG. 4B is a view illustrating the particulars of a sensor in the first embodiment.
Figure 6:
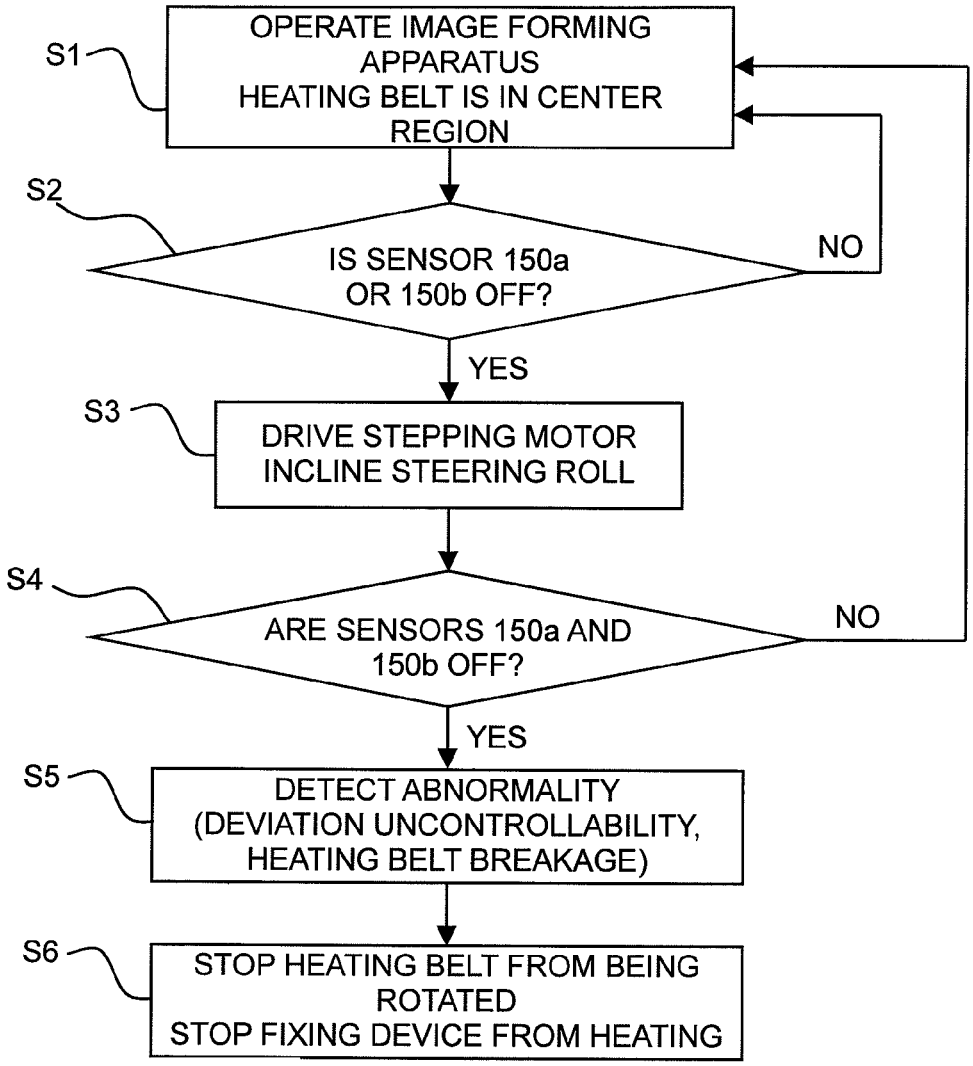
FIG. 6 is a flowchart illustrating a belt deviation control in the first embodiment.

As illustrated in FIG. 4A, the sensor 150 includes two sensors 150*a* and 150*b*, a sensor flag 150*c*, a sensor arm (i.e., a first abutment member) 150*d*, and a sensor spring (i.e., a first biasing member) 150*e*. The sensor arm 150*d* abuts against the end of the heating belt 130 (one end in the belt width direction) under pressure by a force of 3 cN (i.e., 3 gf) by the biasing force of the sensor spring 150*e*. Hence, the sensor arm 150*d* follows the movement of the heating belt 130 in the belt width direction. As illustrated in FIG. 4B, when the sensor arm 150*d* is moved in the belt width direction by the heating belt 130, the sensor flag 150*c* turns the sensors 150*a* and 150*b* at positions at which the sensors 150*a* and 150*b* are turned ON or OFF. The position of the sensor arm 150*d* in the belt width direction is detected based on the combinations of ON/OFF signals of the sensors 150*a* and 150*b*, so that the position of the heating belt 130 is detected. TABLE 1 illustrates the relationship between the end position of the heating belt 130 and the ON/OFF signals of the sensors 150*a* and 150*b* and a method for controlling the end position of the heating belt 130. FIG. 6 is a flowchart illustrating the deviation control of the heating belt 130.

TABLE 1

| | +3.0 mm | +1.0 mm | | −1.0 mm | −3.0 mm |
|---|---|---|---|---|---|
| | BACK | | | FRONT | |
| POSITION OF HEATING BELT | STOPPAGE OF APPARATUS | POSITION AT WHICH ANGLE IS CHANGED | CENTER REGION | POSITION AT WHICH ANGLE IS CHANGED | STOPPAGE OF APPARATUS |
| SENSOR 150a | 1 | 1 | 0 | 0 | 1 |
| SENSOR 150b | 1 | 0 | 0 | 1 | 1 |
| ROTATIONAL DIRECTION OF STEPPING MOTOR DURING DETECTION | — | CW | — | CCW | — |
| ANGLE OF STEERING ROLL | −2 | −2 | — | 2 | 2 |

As illustrated in TABLE 1 and FIG. 6, the heating belt 130 meanders in a section between a first position at which the sensor 150*a* is ON whereas the sensor 150*b* is OFF and a second position at which the sensor 150*a* is OFF whereas the sensor 150*b* is ON. The deviation of the heating belt 130 is controlled in such a manner as to exist in this section. The distance of the section ranges ±1.5 mm from the center position in the belt width direction (in the direction of a rotary shaft of the heating belt 130).

When the heating belt 130 in the center region meanders (S1) and the sensor 150*a* is OFF whereas the sensor 150*b* is ON, the heating belt 130 is detected to be deviated at a position by +1.0 mm from the center position (S2). The stepping motor 155 is clockwise (CW) driven based on the detection signal, and then, the steering roll 132 is inclined by −2° with respect to the drive roll 131. Conversely, when the sensor 150*a* is ON whereas the sensor 150*b* is OFF (S2), the heating belt 130 is detected to be deviated at a position by −1.0 mm from the center position. The stepping motor 155 is counterclockwise (CCW) driven, and then, the steering roll 132 is inclined by +2° with respect to the drive roll 131 (S3). In this manner, the heating belt 130 is moved in a direction in which it returns to the center region, so that its deviation is controlled.

When the end of the heating belt 130 is moved by ±3 mm from the center position to inhibit the deviation control, both of the sensors 150*a* and 150*b* are turned OFF (S4). At this time, the image forming apparatus 100 determines generation of an abnormality (S5), and then, stops the heating operation of the fixing device 114 and the rotational operation of the heating belt 130 (S6).

(Detection of Breakage of Heating Belt 130)

As illustrated in FIG. 2B, a slider (i.e., a second abutment member, that is, a detecting mechanism) 160 abuts at one end 160*a* thereof under pressure against an end of the heating belt 130 on a side opposite to the side on which the sensor 150 is disposed (i.e., the other end of the heating belt 130 in the belt width direction). The slider 160 abuts under pressure with a force of 15 cN (i.e., 15 gf) by a slider spring 161 (i.e., a second biasing member, that is, a detecting mechanism) interposed between an inductive heating coil holding plate 162 and the same. The other end of the heating belt 130 in the width direction functions as a stopper for restricting the movement of the slider 160 in such a manner that the sensor arm 150*d* cannot be moved by the slider 160 when no predetermined breakage occurs at the other end in the width direction of the heating belt 130. The slider spring 161 is urged toward one end of the heating belt 130 in the width direction in such a manner that the sensor arm 150*d* is moved against the sensor spring 150*e* by the slider 160 as soon as a predetermined breakage occurs at the other end in the width direction of the heating belt 130. The slider 160 is held at a plurality of points in the inductive heating coil holding plate 162 in the sheet width direction via step screws 163. The slider 160 is configured to be freely operated in the belt width direction (i.e., the direction of the rotary shaft of the heating belt 130) in such a manner as to follow the movement by the deviation control of the heating belt 130.

As illustrated in FIGS. 2B and 4A, the slider 160 extends near the sensor 150 along the heating belt 130 in the sheet width direction. The other end 160*b* of the slider 160 is separated from the sensor arm 150*d* with a distance of 7 mm. During a normal operation in which the heating belt 130 is not broken, the slider 160 and the sensor arm 150*d* abut under pressure against both ends of the heating belt 130, respectively, and they are operated with the distance of 7 mm held all the time. The slider 160 can be moved by 12 mm toward the sensor arm 150*d* if no heating belt 130 exists (this case is normally impossible).

If the heating belt 130 is broken at the end thereof on the side of the sensor 150, the sensor arm 150*d* is moved in a direction indicated by an arrow in FIG. 4B, such that both of the sensors 150*a* and 150*b* are turned OFF (i.e., +3.0 mm in Table 1), thereby detecting the breakage of the heating belt 130. In this state, the distance of 7 mm is secured during the normal operation in such a manner that the sensor arm 150*d* and the slider 160 are not brought into contact with each other.

Figure 5A:
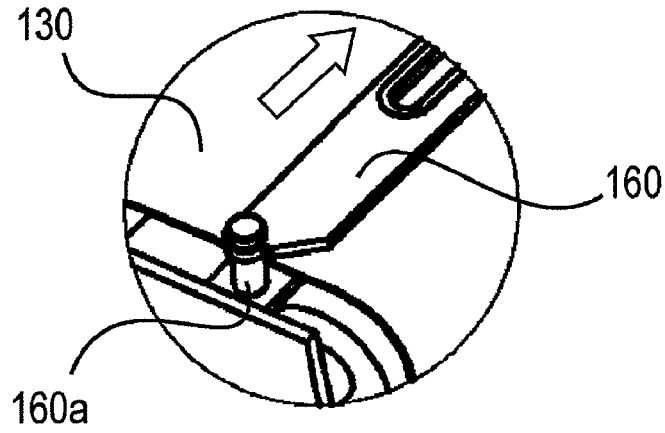
FIG. 5A is an enlarged view illustrating the surroundings of a slider in the first embodiment.
Figure 5B:
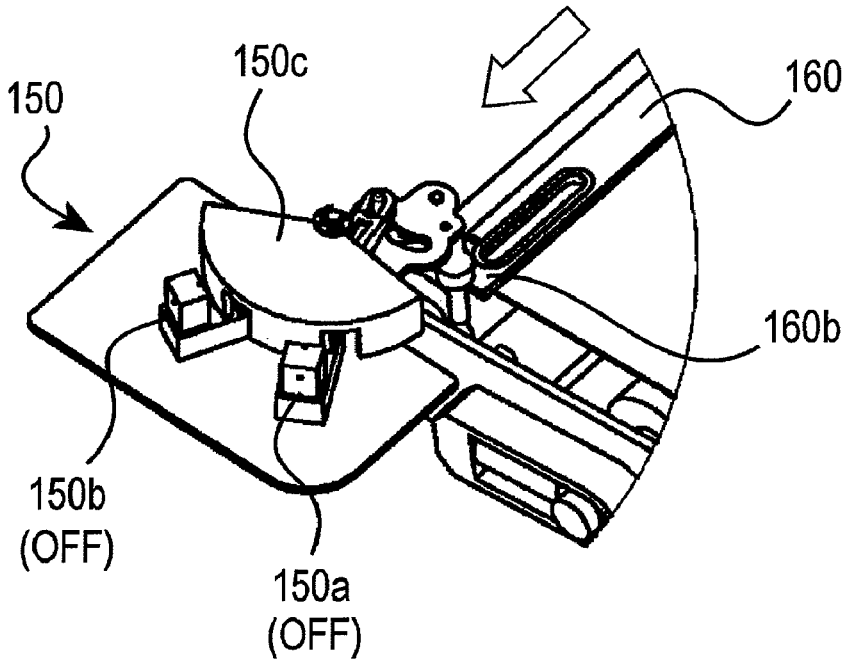
FIG. 5B is an enlarged view illustrating the surroundings of the slider and the sensor when a heating belt is broken in the first embodiment.

If the heating belt 130 is broken at the end thereof on the side opposite to the sensor 150, the slider 160 is moved in a pressurization direction of the slider spring 161 (i.e., in directions indicated by arrows in FIGS. 5A and 5B). When the slider 160 is moved by 7 mm, the other end 160*b* of the slider 160 is brought into contact with the sensor arm 150*d*. The slider 160 pushes the sensor arm 150*d* by 12 mm in a movable region of the slider 160, that is, by 5 mm after the contact owing to the difference in spring force for pressurizing the slider 160 and the sensor arm 150*d* (i.e., 15 cN (15 gf) of the slider 160 whereas 3 cN (3 gf) of the sensor arm 150*d*). As a consequence, both of the sensors 150*a* and 150*b* are turned OFF (i.e., −3.0 mm in Table 1), thereby detecting the breakage of the heating belt 130 (i.e., the state illustrated in FIG. 5B).

When both of the sensors 150*a* and 150*b* are turned OFF after the heating belt 130 is broken (S4 in FIG. 6), the image forming apparatus determines the occurrence of an abnormality (S5 in FIG. 6), like in the case of deviation uncontrollability. And then, the fixing device 114 is stopped from being heated and the heating belt 130 is stopped from being rotated (S6 in FIG. 6).

(Control Portion)

As illustrated in FIG. 3, a control portion 101 performs the above-described deviation control and breakage detection of the heating belt 130. The control portion 101 includes a CPU, a ROM, and the like, receives ON/OFF signals output from the sensors 150*a* and 150*b*, detected by the sensor 150, and thus, performs the above-described control.

(Effects)

In the embodiment, the sensor 150 is disposed at one end of the heating belt 130 in the belt width direction, thus detecting the breakage at the end of the heating belt 130 in the belt width direction. Therefore, the simple and inexpensive configuration can achieve the detection of the breakage at both ends of the belt (the predetermined breakage at one end in the belt width direction or the predetermined breakage at the other end in the belt width direction). The predetermined breakage of the belt herein signifies a situation in which no belt exists in an axial direction (i.e., a direction perpendicular to the belt width direction) in which the abnormality is detected by the sensor 150 irrespective of the belt breakage direction even at a portion in a circumferential direction at the end in the belt width direction. For example, the predetermined breakage of the belt includes a sliced breakage of the belt, a spiral breakage, a breakage in the axial direction, and the like.

Although the description has been given of the fixing device using bidirectional belts as the heating and pressurizing members in the embodiment, either member may be a roller. Moreover, although the description has been given of the fixing device in which both of the heating and pressurizing members use the belts and which is applied onto the side of the heating belt, the fixing device may be applied onto the side of the pressurizing belt or may be applied to both of the belts. Furthermore, the description has been given of the above-described embodiment in which the invention (i.e., the endless belt conveying apparatus) is applied to the heating/fixing device in the image forming apparatus. However, the endless belt according to the present invention is not limited to the heating belt or the pressurizing belt, and therefore, it may be an endless belt conveying apparatus using an electrostatic adsorption conveying belt or an intermediate transfer belt. Alternatively, when the image bearing member is of a belt type, an endless belt conveying apparatus may be an image bearing belt or the like. Additionally, the present invention may be applied to not only the image forming apparatus but also an imaging apparatus or a display apparatus, which requires movement of an endless belt with high accuracy, in the same manner. For example, the present invention may be applied to a film-like belt drive device for a display board of an electronic blackboard, a drive device for an original conveying belt in a scanner, and the like.

Although the two rollers, that is, the drive roll 131 and the steering roll 132 suspend the heating belt 130 in the embodiment, the present invention is not limited to this. The same effect can be produced by applying the present invention to the case of three or more rolls.

[Second Embodiment]

Figure 7A:
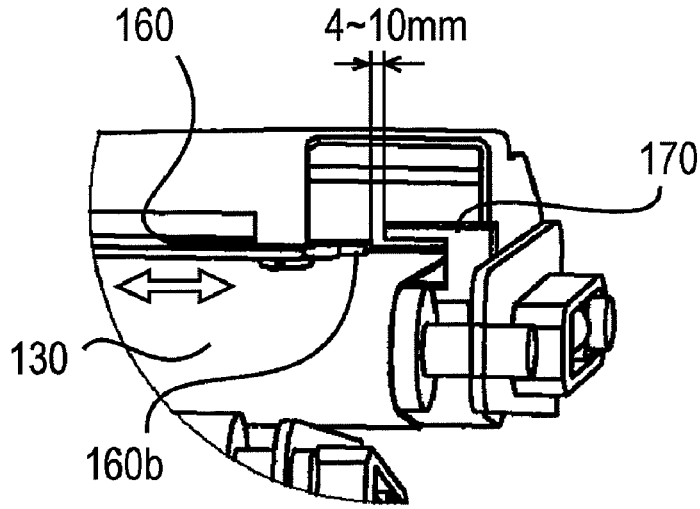
FIG. 7A is an enlarged view illustrating the surroundings of a sensor and a slider in a second embodiment.
Figure 7B:
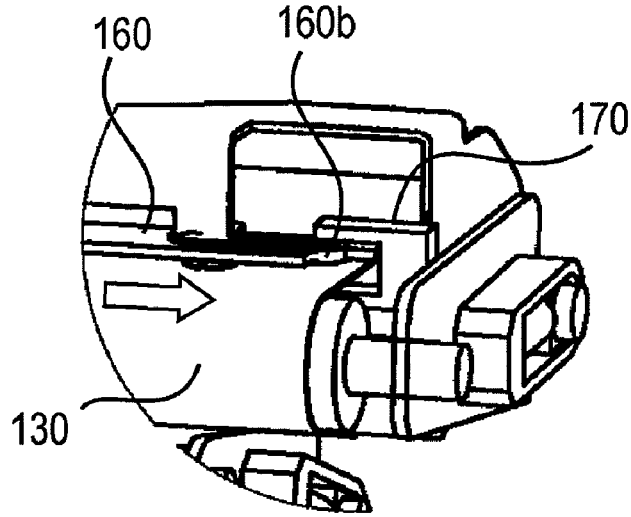
FIG. 7B is an enlarged view illustrating the surroundings of the sensor and the slider when a heating belt is broken in the second embodiment.

Next, a belt conveying apparatus and an image forming apparatus in a second embodiment according to the present invention are described below with reference to the attached drawings. A description duplicated with that in the first embodiment will be omitted by attaching the same reference numerals. FIGS. 7A and 7B are perspective views illustrating both ends in a belt width direction.

As illustrated in FIGS. 7A and 7B, a fixing device 114 in the embodiment includes a sensor 170 in place of the sensor 150 in the first embodiment. The sensor 170 is a non-contact sensor of a transmission type, for detecting the position of an end of a heating belt 130. Table 2 illustrates the relationship between the position of the end of the heating belt 130 and a detection signal output from the sensor 170, and a method for controlling the position of the end of the heating belt 130.

TABLE 2

| | +3.0 mm | +1.0 mm | | −1.0 mm | −3.0 mm |
|---|---|---|---|---|---|
| | BACK | | | FRONT | |
| POSITION OF HEATING BELT | STOPPAGE OF APPARATUS | POSITION AT WHICH ANGLE IS CHANGED | CENTER REGION | POSITION AT WHICH ANGLE IS CHANGED | STOPPAGE OF APPARATUS |
| SENSOR 170 | +B | +A | — | −A | −B |
| ROTATIONAL DIRECTION OF STEPPING MOTOR DURING DETECTION | — | CW | — | CCW | — |
| ANGLE OF STEERING ROLL | −2 | −2 | — | 2 | 2 |

As illustrated in TABLE 2, the deviation of the heating belt 130 is controlled within a section of ±1.5 mm from a center position, like the first embodiment. When the position of ±3.0 mm is detected, it is determined that the deviation cannot be controlled or the heating belt 130 is broken, thereby stopping the operation of the fixing device 114.

As illustrated in FIG. 7A, the other end 160*b* of a slider 160 is separated by 4 mm to 10 mm from the sensor 170 at a position at which the heating belt 130 most approaches the sensor 170. In other words, the slider 160 is located out of a detection range by the sensor 170 during a normal operation, so that the slider 160 and the sensor 170 establish such a positional relationship that the detection of the heating belt 130 by the sensor 170 is not influenced.

In the case where the end of the heating belt 130 on the side of the sensor 170 is broken, the heating belt 130 does not exist in the detectable region by the sensor 170. As a consequence, since the sensor 170 detects the position of ±3.0 mm, it determines that the heating belt 130 is broken, thereby stopping the operation of the fixing device 114.

On the other hand, in the case where the end of the heating belt 130 is broken on the abutment side of the slider 160, the slider 160 is moved toward the sensor 170 (i.e., in a direction indicated by an arrow in FIG. 7B), as illustrated in FIG. 7B, thereby shielding a transmitting light beam from the sensor 170. As a consequence, since the sensor 170 detects the position of ±3.0 mm, it determines that the heating belt 130 is broken, thereby stopping the operation of the fixing device 114.

(Effects)

Like in the first embodiment, the single sensor 170 can detect the breakage of the heating belt 130 at the ends in the belt width direction in the embodiment. Thus, the simple and inexpensive configuration can detect the breakage of the belt.

[Third Embodiment]

Figure 8A:
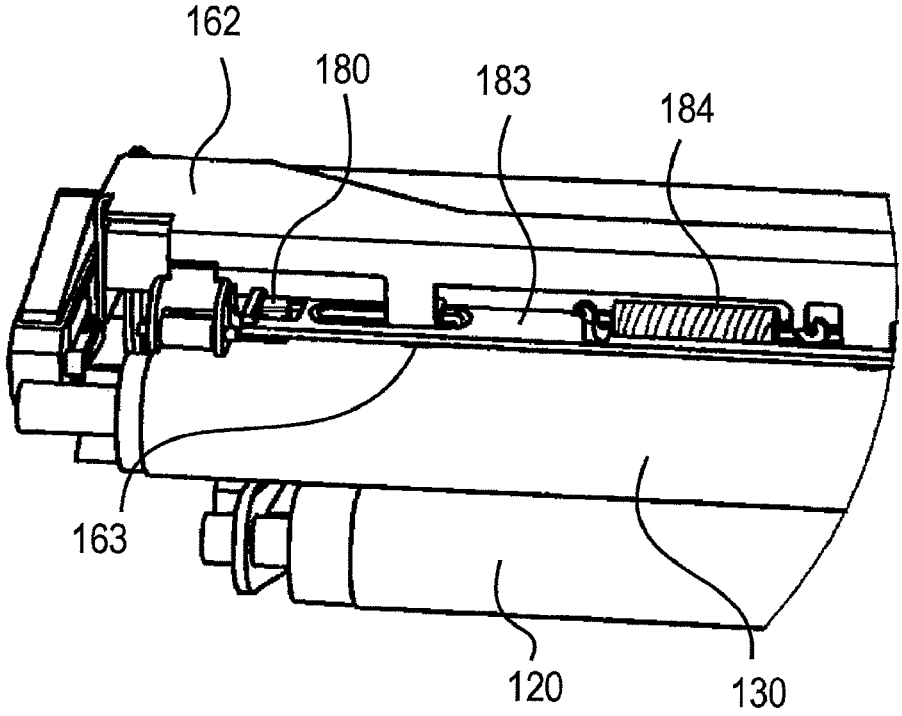
FIG. 8A is a perspective view illustrating the surroundings of a slider and a roll holder in a third embodiment.
Figure 8B:
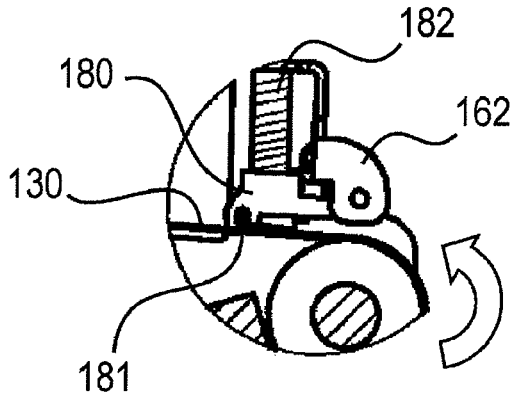
FIG. 8B is a cross-sectional view illustrating the surroundings of the roll holder, as viewed in a rear direction, in the third embodiment.
Figure 9A:
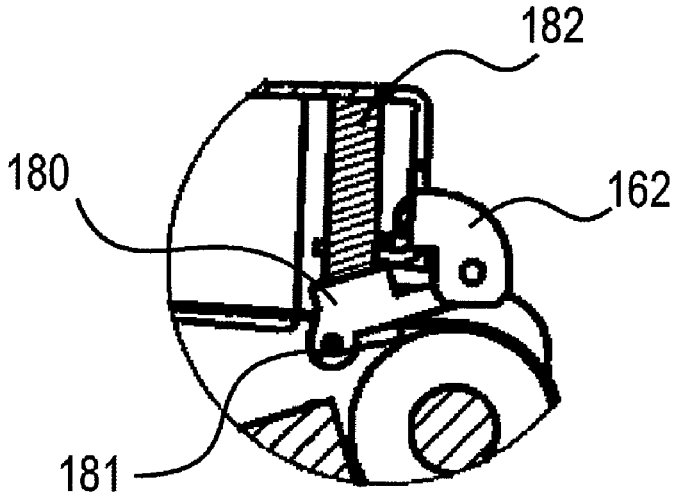
FIG. 9A is an enlarged view illustrating the surroundings of the roll holder when a heating belt is broken in the third embodiment.
Figure 9B:
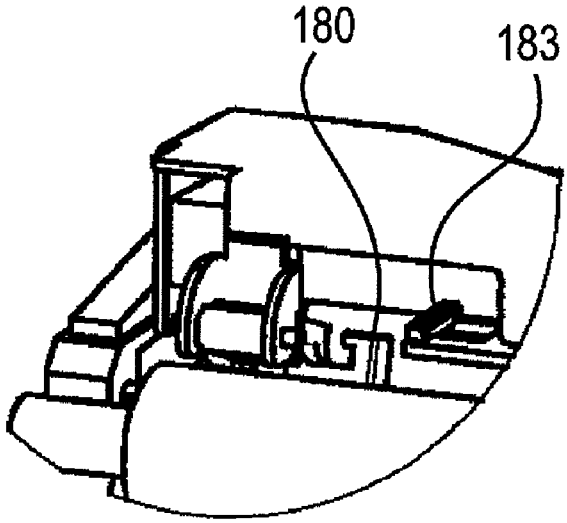
FIG. 9B is a perspective view illustrating the surroundings of the roll holder and the slider when the heating belt is broken in the third embodiment.

Next, a belt conveying apparatus and an image forming apparatus in a third embodiment according to the present invention are described below with reference to the attached drawings. A description duplicated with that in the first embodiment will be omitted by attaching the same reference numerals. FIG. 8A is a perspective view illustrating the surroundings of a slider and a roll holder in the embodiment; FIG. 8B is a cross-sectional view illustrating the surroundings of the roll holder, as viewed in a back direction, in the embodiment; FIG. 9A is an enlarged view illustrating the surroundings of the roll holder when a heating belt is broken in the embodiment; and FIG. 9B is a perspective view illustrating the surroundings of a roll holder and a slider when the heating belt is broken in the embodiment. As illustrated in FIGS. 8A and 8B, a fixing device 114 in the embodiment includes a slider 183 (i.e., a second abutment member, that is, a detecting mechanism) in place of the slider 160 in the first embodiment, and further, is provided with a roll holder 180 and a roll 181 (i.e., a second abutment member). The roll 181 is held at a surface in a non-image region of a heating belt 130 on a side opposite to a sensor 150 by the roll holder 180. The roll 181 abuts under pressure against the surface at the other end of the heating belt 130 in the width direction by a spring 182 (i.e., a third biasing member) via the roll holder 180. The roll 181 is rotated while following the rotation of the heating belt 130.

The roll holder 180 is turnably held by an inductive heating coil holding plate 162 on a turn shaft parallel to the rotary shaft of the heating belt 130. The roll holder 180 has a stopper 180*a* for restricting the movement of a slider 183 such that a sensor arm 150*d* cannot be moved by the slider 183 when the roll 181 is pressed against the surface of the heating belt 130. The slider 183 is pulled toward the sensor 150 by a force of 15 cN (15 gf) by a slider spring 184 (i.e., a second biasing member, that is, a detecting mechanism), so that it is hooked on the stopper 180*a* of the roll holder 180, to be thus positioned thereat. The slider 183 is held in the inductive heating coil holding plate 162 via step screws 163 in such a manner as to slide in the direction of the rotary shaft of the heating belt 130, like in the first embodiment.

Like in the first embodiment, if the heating belt 130 is broken at the end thereof on the side of the sensor 150, the sensor arm 150*d* is moved in a direction indicated by an arrow in FIG. 4B, such that both of the sensors 150*a* and 150*b* are turned OFF (i.e., +3.0 mm in Table 1), thereby detecting the breakage of the heating belt 130.

On the other hand, if the end of the heating belt 130 is broken at the abutment portion against the roll 181, the roll 181 and the roll holder 180 are turned toward the inner surface of the heating belt, as illustrated in FIGS. 9A and 9B. In this manner, the slider 183 is detached from the stopper 180*a*, and then, the slider 183 is moved toward the sensor 150 by the spring force. As a consequence, the other end of the slider 183 pushes the sensor arm 150*d*, so that both of the sensors 150*a* and 150*b* are turned OFF (−3 mm in Table 1), thereby detecting the breakage of the heating belt 130, like in the first embodiment.

The image forming apparatus determines the occurrence of an abnormality when both of the sensors 150*a* and 150*b* are turned OFF, thus stopping the heating operation of the fixing device 114 and the rotational operation of the heating belt 130, like in the case of deviation uncontrollability.

(Effects)

Like in the first embodiment, the single sensor 150 can detect the breakage of the heating belt 130 at the ends in the belt width direction in the embodiment. Thus, the simple and inexpensive configuration can detect the breakage of the belt.

[Fourth Embodiment]

Figure 10A:
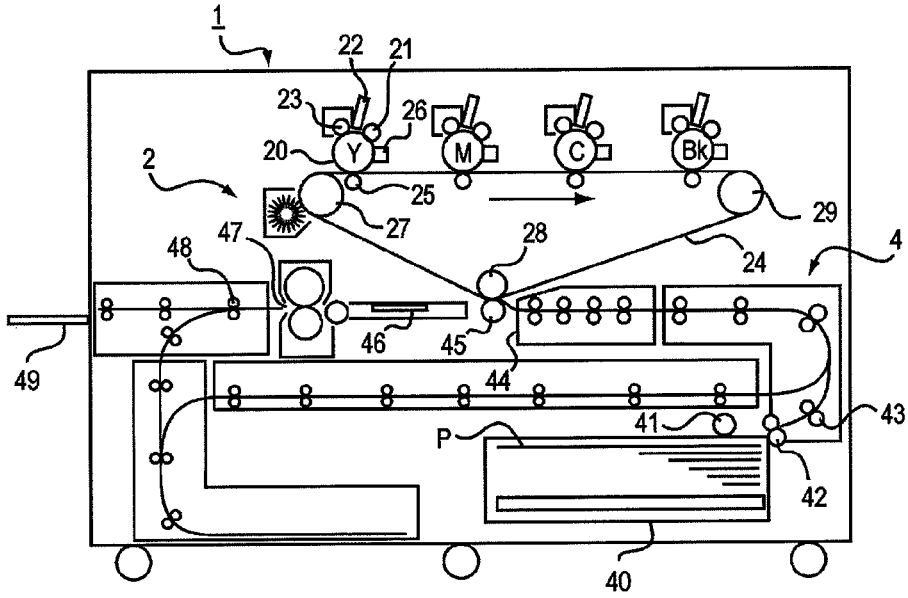
FIG. 10A is a view illustrating an image forming apparatus in a fourth embodiment.
Figure 10B:
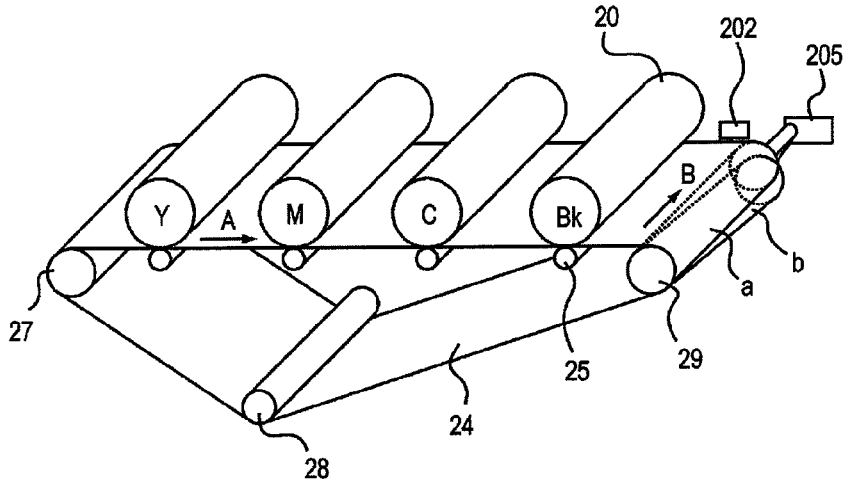
FIG. 10B is a perspective view schematically illustrating an intermediate transfer belt and a photosensitive drum in the image forming apparatus in the third embodiment.

Next, a belt conveying apparatus and an image forming apparatus in a fourth embodiment according to the present invention are described below with reference to the attached drawings. A description duplicated with that in the first embodiment will be omitted by attaching the same reference numerals. FIGS. 10A and 10B are views illustrating an image forming apparatus in the embodiment. Here, a description will be schematically given of the entire configuration of the image forming apparatus and the configuration around an intermediate transfer belt member. Subsequently, another description will be given of a breakage detecting configuration for a belt member, which is the feature of the embodiment.

{Entire Configuration of Image Forming Apparatus}

FIG. 10A is a cross-sectional view illustrating the image forming apparatus in the embodiment. As illustrated in FIG. 10A, the image forming apparatus in the embodiment is exemplified by a color printer of an intermediate transfer system, in which four image stations are arranged horizontally.

The image forming apparatus in the embodiment includes an image forming portion 2 in an upper portion inside of a printer body 1 and a sheet conveying portion 4 in a lower portion thereof. The image forming portion 2 has four image forming stations which form toner images of yellow Y, magenta M, cyan C, and black Bk arranged in a horizontal direction. In each of the image forming stations, a photosensitive drum 20 serving as an image bearing member is disposed in such a manner as to be rotatably driven. Around the photosensitive drum 20 are arranged a charging portion 21 for electrically charging the surface of the photosensitive drum 20 and an LED unit 22 serving as an exposing unit for forming an electrostatic latent image on the photosensitive drum 20. Moreover, there are provided a development device 23 for developing the electrostatic latent image on the photosensitive drum with a toner and a cleaner 26 for removing a toner remaining on the photosensitive drum.

Under the photosensitive drums 20 is rotatably disposed an intermediate transfer belt 24 serving as a belt member with which each of the photosensitive drums 20 can be brought into press-contact. The photosensitive drums 20 are driven while following the rotation of the intermediate transfer belt 24. Furthermore, primary transfer rollers 25 (i.e., image forming units) are rotatably driven in press-contact with the intermediate transfer belt 24 at positions opposite to the photosensitive drums 20 via the intermediate transfer belt 24.

The intermediate transfer belt 24 is stretched across a drive roller 27, a secondary transfer inner roller 28 (i.e., a transfer member), and a tension roller 29.

In forming an image, a toner image of each of colors is formed on each of the photosensitive drums 20 which is rotated counterclockwise in FIG. 10A by an electrophotographic system. The toner images are transferred onto the intermediate transfer belt 24 which is rotated clockwise in FIG. 10A, in sequential superimposition by applying a bias to the primary transfer roller 25, thereby forming a color image.

A recording sheet P serving as a recording medium is conveyed from the sheet conveying portion to a secondary transfer portion in synchronism with the image formation. The sheet conveying portion 4 is configured such that the recording sheets P stacked in a sheet cassette 40 are fed by a feed roller 41 and are separated one by one by a pair of separation rollers 42, to be then conveyed to a pair of registration rollers 44 by a plurality of conveying rollers 43. The recording sheet P conveyed by the pair of registration rollers 44 is conveyed onto the intermediate transfer belt 24 at the same timing as the toner image on the intermediate transfer belt 24.

The toner image on the intermediate transfer belt 24 is transferred onto the recording sheet P by applying a bias to a secondary transfer outer roller 45. The recording sheet P is conveyed to a fixing device 47 by a conveying belt 46, and then, the toner image is fixed on the recording sheet P. Thereafter, the recording sheet P is discharged onto a discharge tray 49 via discharge rollers 48.

{Configuration of Belt Deviation Control}

The image forming apparatus in the embodiment is configured in such a manner as to detect and correct the deviation of the intermediate transfer belt 24. A description will be given below of the configuration for the detection and correction. FIG. 10B is a perspective view schematically illustrating the intermediate transfer belt 24 and the photosensitive drum 20 in the image forming apparatus in the embodiment.

As illustrated in FIG. 10B, when the drive roller 27 is rotated in a direction indicated by an arrow, the intermediate transfer belt 24 stretched across the drive roller 27, the secondary transfer inner roller 28, and the tension roller 29 is rotated in a rotational direction (i.e., a direction indicated by an arrow A). The intermediate transfer belt 24 may be possibly deviated in the belt width direction perpendicular to the rotational direction due to an error of parallelism of the rollers, across which the intermediate transfer belt 24 is stretched, as described already. In the image forming apparatus in the embodiment, a deviation detecting unit detects the deviation of the intermediate transfer belt 24.

Figure 10C:
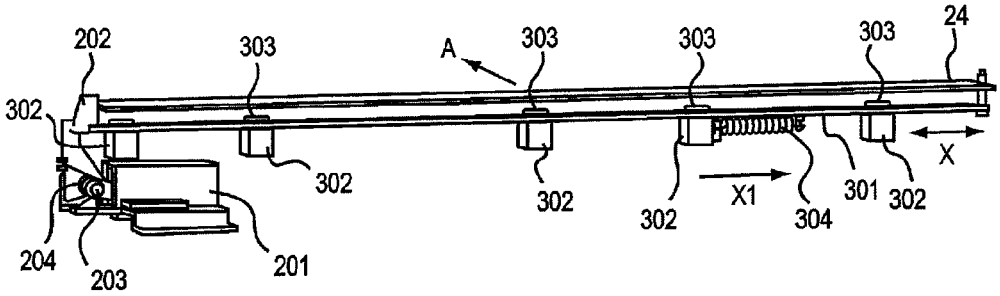
FIG. 10C is a perspective view illustrating a sensor and a slider in the third embodiment.

In the deviation detecting unit, a belt end detecting sensor 201 disposed at the end of the intermediate transfer belt 24 (i.e., an end in the belt width direction) detects an end, so as to detect the deviation of the intermediate transfer belt 24. Specifically, as illustrated in FIG. 10C, a detecting arm (i.e., a first biasing member) 202 disposed rotatably on a shaft 203 is urged against the end of the intermediate transfer belt 24 by a spring 204. The turn of the detecting arm 202 enables the end of the intermediate transfer belt 24 to be detected based on an output from the sensor 201. A region can be detected by the detecting sensor 201 within ±5 mm of the end of the intermediate transfer belt 24. That is to say, the deviation is controlled such that the intermediate transfer belt 24 is located within ±2 mm in the image forming apparatus. In the case of the detection beyond ±2 mm, it is determined that the deviation of the intermediate transfer belt 24 cannot be controlled or the intermediate transfer belt 24 is broken, thereby stopping the rotation of the intermediate transfer belt 24. Meanwhile, as illustrated in FIG. 10B, one end of the tension roller 29 in a longitudinal direction can be moved within a slight range. The tension roller 29 is vertically oscillated by driving an oscillating motor 205 connected to the end of the tension roller 29, so that the tension roller 29 is inclined in the horizontal direction. As a consequence, the deviation of the belt can be corrected by oscillating the tension roller 29 according to the detection result of the belt end detecting sensor 201. For example, when the tension roller 29 is descended from a position a to a position b in FIG. 10B, the intermediate transfer belt 24 is moved (i.e., deviated) downward (i.e., in a direction indicated by an arrow B) as it is rotated. Conversely, when one end of the tension roller 29 is ascended, the intermediate transfer belt 24 is deviated in a direction reverse to the direction indicated by the arrow B. The belt deviation is restricted at all times in response to the detection signal from the belt end detecting sensor 201, thus stably rotating the intermediate transfer belt 24.

Subsequently, a description will be given of a belt breakage detecting unit which is disposed at an end opposite to the deviation detecting unit and the intermediate transfer belt 24. A slider (i.e., detecting mechanism) 301 is supported by frames 302 for an intermediate transfer belt unit via step screws 303 in such a manner as to be freely moved in a direction indicated by an arrow X illustrated in FIG. 10C. The slider 301 is urged against an end of the intermediate transfer belt 24 oppositely to the deviation detecting sensor 201 (i.e., in a biasing direction X1) by a spring (i.e., the detecting mechanism) 304. The slider 301 extends near the sensor 201 from the side in biasing abutment against the intermediate transfer belt 24, and therefore, it is separated from the detecting arm 202 by 4 mm in the normal state. The slider 301 can be moved by 5 mm in the biasing direction X1 and by 10 mm on the side of the detecting arm 202 to the reference position of the intermediate transfer belt 24. In the case where the intermediate transfer belt 24 is broken on the side of the abutment of the slider 301, the slider 301 is moved toward the detecting arm 202, thereby pushing the detecting arm 202. Thus, the detecting sensor 201 detects the belt end beyond +2 mm.

In the embodiment, the single sensor 201 can detect the breakage at the end of the intermediate transfer belt 24 in the belt width direction, like in the first embodiment. Consequently, the simple and inexpensive configuration can detect the breakage of the belt. Incidentally, although the description has been given of the belt conveying apparatus using the intermediate transfer belt in the embodiment, the intermediate transfer belt may be replaced by an electrostatic adsorption belt. Specifically, a sheet is conveyed to an electrostatic adsorption belt by conveying rollers (i.e., supplying units), an image may be directly transferred onto the sheet conveyed via the electrostatic adsorption belt from the image forming unit.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2009-179962 filed Jul. 31, 2009, which is hereby incorporated by reference herein in its entirety.

What is claimed is:

1. A belt conveying apparatus comprising:

an endless belt;

a supporting member that rotatably supports the belt;

a first abutment member that abuts against one end of the belt in a belt width direction;

a first biasing member that urges the first abutment member against the other end of the belt in the belt width direction;

a sensor that detects the position of the first abutment member in the belt width direction;

a deviation mechanism that deviates the supporting member in response to an output from the sensor;

a second abutment member that abuts against the other end of the belt in the belt width direction; and a second biasing member that urges the second abutment member toward one end of the belt in the belt width direction in such a manner that the first abutment member is moved against the first biasing member by the second abutment member according to a predetermined breakage at the other end of the belt in the belt width direction.

2. The belt conveying apparatus according to claim 1, wherein the second abutment member is disposed in such a manner as to abut against the other end of the belt in the belt width direction, the other end of the belt in the belt width direction functioning as a stopper which restricts the movement of the second abutment member in such a manner as that the first abutment member is not moved by the second abutment member when no predetermined breakage occurs at the other end of the belt in the belt width direction.

3. The belt conveying apparatus according to claim 1, further comprising:

a third biasing member that urges the second abutment member against the surface at the other end of the belt in the belt width direction; and a stopper that restricts the movement of the second abutment member in such a manner as that the first abutment member is not moved by the second abutment member when the second abutment member is pressed against the surface of the belt.

4. An image forming apparatus provided with the belt conveying apparatus according to claim 1, comprising:

an image forming unit that forms an image on a sheet, wherein the belt conveying apparatus conveys the sheet when the image formed on the sheet by the image forming unit is heated.

5. An image forming apparatus provided with the belt conveying apparatus according to claim 1, comprising:

a supplying unit that supplies a sheet to the belt conveying apparatus; and an image forming unit that forms an image on a sheet born by the belt conveying apparatus.

6. An image forming apparatus provided with the belt conveying apparatus according to claim 1, comprising:

an image forming unit that forms an image on the belt conveying apparatus; and a transfer member that transfers the image formed on the belt conveying apparatus onto a sheet.

* * * * *